United States Patent [19]

Stoltz

[11] Patent Number: 4,569,419

[45] Date of Patent: Feb. 11, 1986

[54] FOLDABLE STEPLADDER

[75] Inventor: Gérard Stoltz, Pont Sainte Marie, France

[73] Assignee: Denyse Stoltz, Pont Sainte Marie, France; a part interest

[21] Appl. No.: 726,623

[22] Filed: Apr. 24, 1985

[30] Foreign Application Priority Data

Apr. 25, 1984 [FR] France ..... 84 06489

[51] Int. Cl.[4] ..... E06C 1/383

[52] U.S. Cl. ..... 182/160; 182/162; 182/170

[58] Field of Search ..... 182/159, 160, 161, 162, 182/170

[56] References Cited

U.S. PATENT DOCUMENTS

| | | | |
|---|---|---|---|
| 419,821 | 1/1890 | Burrows | 182/170 |
| 958,732 | 5/1910 | Dennis | 182/160 |
| 1,054,108 | 2/1913 | Garraway | 182/160 |
| 1,108,896 | 9/1914 | Garraway | 182/160 |
| 1,337,361 | 4/1920 | Kasper | 182/159 |
| 1,783,686 | 12/1930 | Williams | 182/160 |
| 2,184,486 | 12/1939 | Chew | 182/170 |
| 3,084,760 | 4/1963 | Lamberti | 182/160 |

*Primary Examiner*—Reinaldo P. Machado

*Attorney, Agent, or Firm*—Lawrence M. Nawrocki

[57] ABSTRACT

The present invention relates to a foldable stepladder constituted by:

a first pair of two main uprights, a plurality of steps, a device for maintaining said steps in their unfolded configuration, a second pair of two auxiliary uprights, wherein the auxiliary uprights are articulated at one of their ends on the upper part of the main uprights and they are articulated on each other about a pin in their median part to present, in unfolded position of use, the form of a cross, said auxiliary uprights being connected from said mutual pivot point to the central upright by a connecting rod. The invention is more particularly applicable to the manufacture of foldable stepladders.

7 Claims, 5 Drawing Figures

FOLDABLE STEPLADDER

The present invention relates to a foldable stepladder.

Foldable stepladders are known which are constituted by:

- a first pair of two main, generally parallel, uprights;
- a plurality of rungs, each comprising two parts articulated, on the one hand, one on one of the main uprights, the other on the other main upright, on the other hand, on each other and on a central upright which is generally parallel to the main uprights and to said parts of each rung;
- a device for maintaining said rungs in their unfolded configuration;
- a second pair of two auxiliary uprights associated with said main uprights to maintain said main uprights and said rungs in their position of use;
- compasses having two legs articulated on each other and each articulated on one of the auxiliary uprights in order to maintain these auxiliary uprights in spaced apart relationship when the stepladder is in use.

However, such foldable stepladders comprise relatively complicated means for placing them in position of use and in folded up position and it is particularly difficult to manoeuvre them.

Furthermore, stability of these stepladders is not always absolutely perfect.

It is an object of the present invention to overcome these drawbacks.

According to the invention, the auxiliary uprights are articulated at one of their ends on the upper part of the main uprights and they are articulated on each other about a shaft in their median part to present, in unfolded position of use, the form of a cross, said auxiliary uprights being connected from said mutual point of articulation to the central upright by a connecting rod.

With the device according to the invention, opening of the stepladder is total and simultaneous upon opening of the auxiliary uprights by moving the main uprights away.

Stability is excellent, the rear auxiliary uprights forming a three-sided triangulation with the spacer rod.

As the stepladder does not require any locking, opening and closure thereof may be effected in one manoeuvre.

The invention will be more readily understood on reading the following description with reference to the accompanying drawings, in which.

Figure 1:
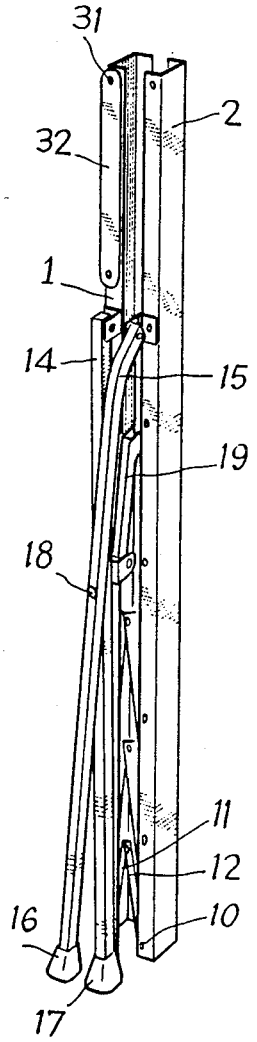
FIG. 1 is a view of the stepladder in side elevation and in folded position.

Referring now to the drawings, FIGS. 1, 2, 4 and 5 show a stepladder according to the invention which comprises two main uprights 1 and 2, a central upright 3 and steps in two parts 4 and 5 which are each mounted to pivot, on the one hand, on the main uprights about pins 6, 7, respectively perpendicular to the plane of the main uprights 1, 2 and in fact generally horizontal, on the other hand, on the central upright about pins 8, parallel to said pins 6 and 7.

The steps 4, 5 present in transverse section a trapezoidal form with a flat part for support.

Figure 2:
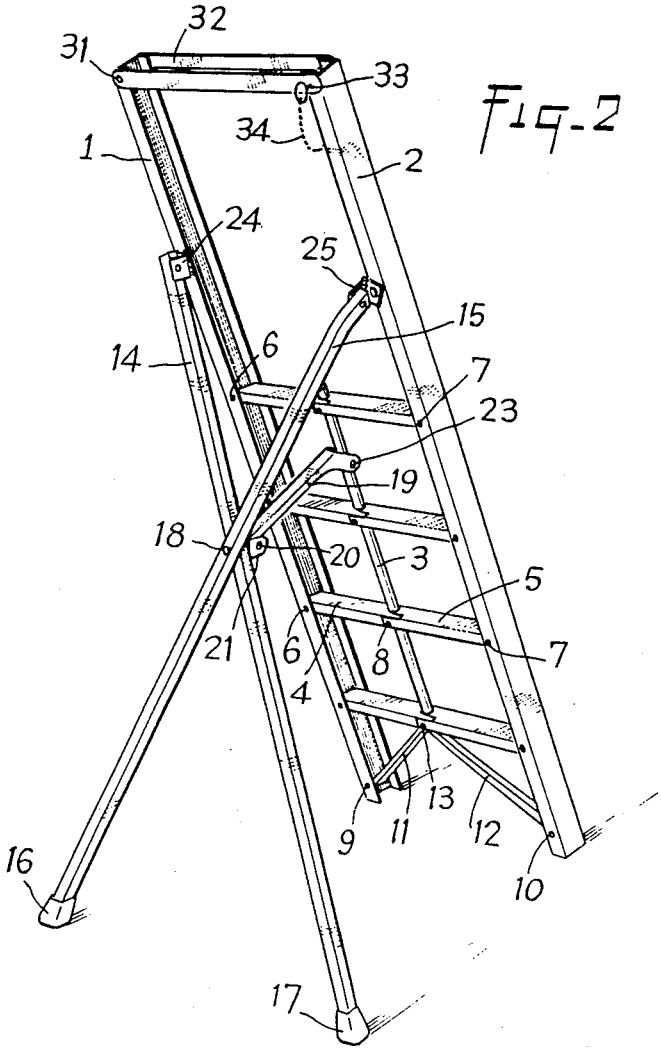
FIG. 2 is a view of the stepladder in rear elevation and in unfolded position for use thereof.

In the lower part of the main uprights are articulated about pins 9, 10, the two legs 11 and 12 of compasses, which legs are articulated on each other about a pin 13, said legs, whose length is greater than parts 4 and 5 of the steps, forming an angle of which the apex is directed upwardly to engage in a corresponding housing provided at the base of the central upright 3 when the stepladder is in unfolded position (FIG. 2).

In the upper part of the main uprights 1, 2 are articulated, at one of their ends, auxiliary uprights 14, 15 which rest on the ground by their other end 16, 17, said auxiliary uprights being articulated on each other in their median part about a pin 18 to present in unfolded position for use (FIG. 2) the form of a cross. The auxiliary uprights 14, 15 are connected from the pivot pin 18 by a small rod 19 to the central upright 3. To this end, one of the ends of the connecting rod 19 is articulated about a pin 20 mounted on a fork joint 21 itself articulated on the pin 18 for connection of the auxiliary uprights 14, 15; at its other end the rod 19 is articulated on a pin 23 engaged on the central upright 3.

The articulation of auxiliary uprights 14, 15 (FIGS. 4, 5) on the upper part of the main uprights 1, 2 is effected by means of hinges 24, 25. Each hinge such as 24 comprises a pin 26 and two arms 27, 28 which are articulated respectively about a pin 29 on the main upright 1, 2 and about a pin 30 on the auxiliary upright 14, 15.

Pin 26 of hinge 24, 25 is perpendicular to pins 29 and 30 for articulation on the main upright 1, 2 and on the auxiliary upright 14, 15.

Figure 3:
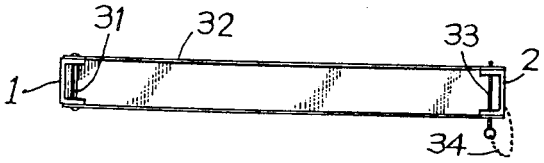
FIG. 3 is a plan view showing the removable upper crosspiece.
Figure 4:
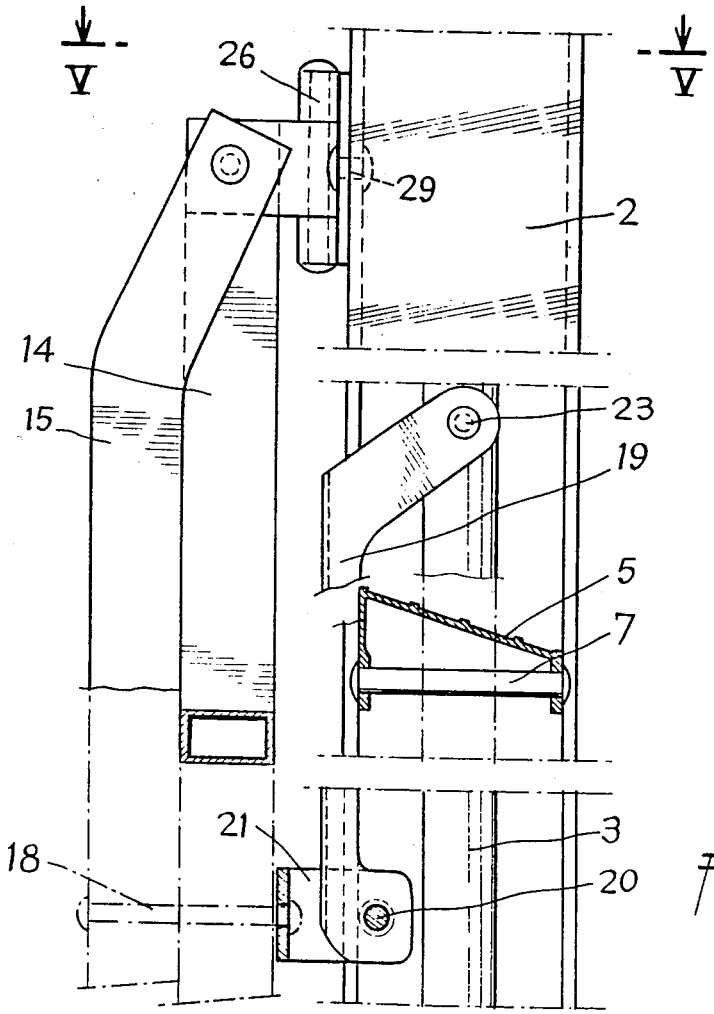
FIG. 4 is a view in elevation on a larger scale showing the means for articulation of the uprights.
Figure 5:
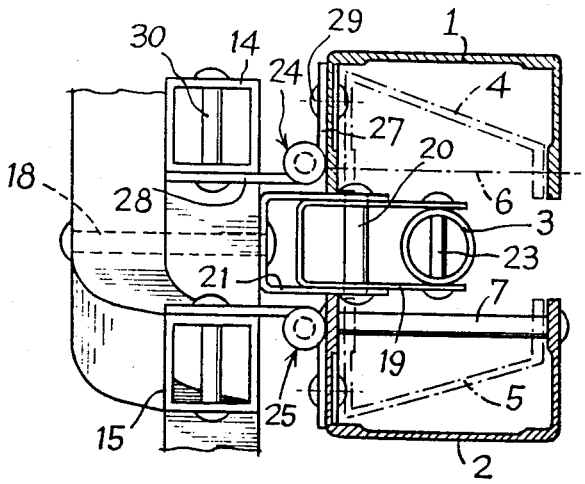
FIG. 5 is a view in section along line V—V of FIG. 4.

In the upper part of the main upright 1, there is articulated about a pin 31 a crosspiece 32 (FIGS. 1, 2, 3) constituted by a U-shaped section of which the other end is removably fixed on the upright 2 by means of a pin 33 connected to said upright by a chain 34. The crosspiece 32 constitutes a groove adapted to support small objects and it reinforces rigidity of the stepladder.

The device according to the invention operates as follows:

When the stepladder is in folded position as shown in FIG. 1, it suffices to move the main uprights 1, 2 laterally apart from each other so that the two parts 4, 5 of the steps occupy a horizontal position for use and the two legs of the compasses 11, 12 come into abutment by their vertex against the central upright 3.

During displacement of uprights 1, 2, the auxiliary uprights 14, 15 are moved away from each other, pivoting about their central axis 18 and the connecting rod 19 is moved, pivoting about axes 20 and 23 to occupy the position shown in FIG. 2.

The spacer rod 19 with the auxiliary uprights 14, 15 form a three-sided triangulation which ensures excellent stability of the stepladder.

The crosspiece 32 is then mounted and held by its pin 33.

The invention is, of course, not limiting and the man skilled in the art may make modifications thereto without departing from the domain of the invention; in particular, hinges 24, 25 may be replaced by ball-and-socket joints.

What is claimed is:

1. In a foldable stepladder constituted by:

a first pair of two generally parallel main uprights, a plurality of steps, each comprising two parts articulated on the one hand, one on one of the main uprights, the other, on the other main upright, on the other hand, on each other and on a central upright generally parallel to the main uprights, about axes perpendicular to the plane of said main uprights and to said parts of each step, a device for maintaining said steps in their unfolded configuration, a second pair of two auxiliary uprights associated with said main uprights to maintain said main uprights and said steps in their position of use, the auxiliary uprights are articulated at one of their ends on the upper part of the main uprights and they are articulated on each other about a pin in their median part to present, in unfolded position of use, the form of a cross, said auxiliary uprights being connected from said mutual pivot point to the central upright by a connecting rod.

2. The foldable stepladder of claim 1, wherein the connecting rod is articulated at one of its ends about a pin fast with the central upright and at the other end about a pin engaged on a fork joint, itself articulated on the mutual connecting pin of the auxiliary uprights.

3. The foldable stepladder of claim 1, wherein each auxiliary upright is articulated on the upper part of a main upright along three perpendicular axes.

4. The foldable stepladder of claim 3, wherein the connection between each auxiliary upright and each main upright is made by means of a hinge of which the arms are mounted to pivot on each main upright and on each auxiliary upright about a pin perpendicular to the pin of the hinge.

5. The foldable stepladder of claim 1, wherein, at the top end of one of the main uprights, a U-sectioned crosspiece is mounted to pivot at one of its ends, the other end of which is capable of being fixed to the upper part of the other upright by means of a pin, said crosspiece constituting a groove adapted to support small objects.

6. The foldable stepladder of claim 1, wherein the flat steps thereof are in the form of trapeziums.

7. The foldable stepladder of claim 1, wherein each auxiliary upright is articulated on the upper part of a main upright by means of ball-and-socket joints.

* * * * *